US011769645B2

(12) United States Patent
Karasawa

(10) Patent No.: US 11,769,645 B2
(45) Date of Patent: Sep. 26, 2023

(54) MOTOR DEVICE

(71) Applicant: NIDEC SANKYO CORPORATION, Nagano (JP)

(72) Inventor: Junya Karasawa, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 0 days.

(21) Appl. No.: 17/739,170

(22) Filed: May 9, 2022

(65) Prior Publication Data

US 2022/0375706 A1 Nov. 24, 2022

(30) Foreign Application Priority Data

May 20, 2021 (CN) ..... 202121083057.4

(51) Int. Cl.
*H01H 43/02* (2006.01)
*H01H 43/10* (2006.01)

(52) U.S. Cl.
CPC ..... *H01H 43/026* (2013.01); *H01H 43/022* (2013.01); *H01H 43/101* (2013.01)

(58) Field of Classification Search
CPC ..... G04F 3/06; G04F 3/00; F25D 21/06; F25D 21/008; H01H 43/101; H01H 43/022; H01H 43/02; H01H 43/026; H01H 43/10; H01H 43/024; H01H 1/36; H01H 1/44; H01H 9/04; H01H 9/042
See application file for complete search history.

(56) References Cited

U.S. PATENT DOCUMENTS 5,609,491 A * 3/1997 Cooper ..... H01R 27/02 439/494
5,929,403 A * 7/1999 Amonett ..... H01H 43/101 200/38 B
2019/0259555 A1 8/2019 Karasawa

FOREIGN PATENT DOCUMENTS

JP 2018045849 3/2018

* cited by examiner

*Primary Examiner* — Anthony R Jimenez
(74) *Attorney, Agent, or Firm* — JCIPRNET

(57) ABSTRACT

A motor device includes a shell, a motor body and a connection terminal. The motor body is supported on the shell and includes a power supply terminals a support and a lead wire. The power supply terminal penetrates a through hole of the support in a first direction and is pressed into a pressing portion of the connection terminal. The lead wire extends from the power supply terminal in a direction perpendicular to the first direction, or extends in a direction inclined with respect to the first direction toward a side approaching the connection terminal. A first protrusion restricting movement of the power supply terminal in the first direction toward a side opposite to the connection terminal is provided at a position on the shell facing the power supply terminal in the first direction.

10 Claims, 8 Drawing Sheets

MOTOR DEVICE

CROSS REFERENCE TO RELATED APPLICATIONS

The present invention claims priority under 35 U.S.C. § 119 to China Application No. 202121083057.4 filed on May 20, 2021, the entire content of which is incorporated herein by reference.

FIELD OF THE INVENTION

At least one embodiment of the disclosure relates to a motor device.

BACKGROUND

An existing contact-type timing switch includes a shell, a motor, a plurality of conductive parts and a contact moving mechanism. The motor, the conductive parts and the contact moving mechanism are received in the shell. The plurality of conductive parts each have a contact, and the contact moving mechanism enables at least one of the contacts of the conductive parts to move to a position in contact with other contacts to achieve electrical connection. The contact moving mechanism includes a cam and a gear transmission mechanism, the cam has a cam surface on which the conductive parts slide, and the gear transmission mechanism transmits the driving force of the motor to the cam.

The contact-type timing switch generally further includes a support, power supply terminals and a plurality of tabs. The support is fixed to the motor, and extends from one side of the rotation center line of a motor rotor to the outer circumference. The power supply terminals penetrate an outer circumference end of the support along the axis of the motor, and one ends of the power supply terminals are pressed into tabs. Coil wires of the motor extend from one side of the rotation center line of the motor rotor to the outer circumference in a direction perpendicular to the rotation center line, and are wound and fixed on the other ends of the power supply terminals. The plurality of tabs respectively protrude to the outside of the shell to form connection terminals connected to the outside, some of the tabs are connected to the conductive parts, and the remaining tabs are connected (electrically connected) to the motor.

When the contact-type timing switch is manufactured, the support is usually first fixed to the motor, the power supply terminals are inserted in the support, and the front ends of the coil wires of the motor are wound and fixed on the power supply terminals. In this state, the motor is received and fixed to the shell. Then the plurality of tabs is pressed to the ends of the power supply terminals opposite to the ends on which the coil wires are wound. However, when the plurality of tabs are pressed to the ends of the power supply terminals, the power supply terminals may move relative to the support due to the pressing force from the tabs, which in turn drives the front ends, wound and fixed on the power supply terminals, of the coil wires to move. As a result, the coil wires may be excessively tightened and broken.

SUMMARY

An exemplary embodiment of the disclosure provides a motor device, including a shell, a motor body and a connection terminal. The motor body is supported on the shell and includes a power supply terminal, a support, and a lead wire. The power supply terminal penetrates a through hole of the support in a first direction and is pressed into a pressing portion of the connection terminal. The lead wire extends from the power supply terminal in a direction perpendicular to the first direction, or extends in a direction inclined with respect to the first direction toward a side approaching the connection terminal. A first protrusion restricting movement of the power supply terminal in the first direction toward a side opposite to the connection terminal is provided at a position on the shell facing the power supply terminal in the first direction.

The above and other elements, features, steps, characteristics and advantages of the present disclosure will become more apparent from the following detailed description of the preferred embodiments with reference to the attached drawings.

BRIEF DESCRIPTION OF THE DRAWINGS

Embodiments will now be described, by way of example only, with reference to the accompanying drawings which are meant to be exemplary, not limiting, and wherein like elements are numbered alike in several figures, in which.

DETAILED DESCRIPTION

Figure 1:
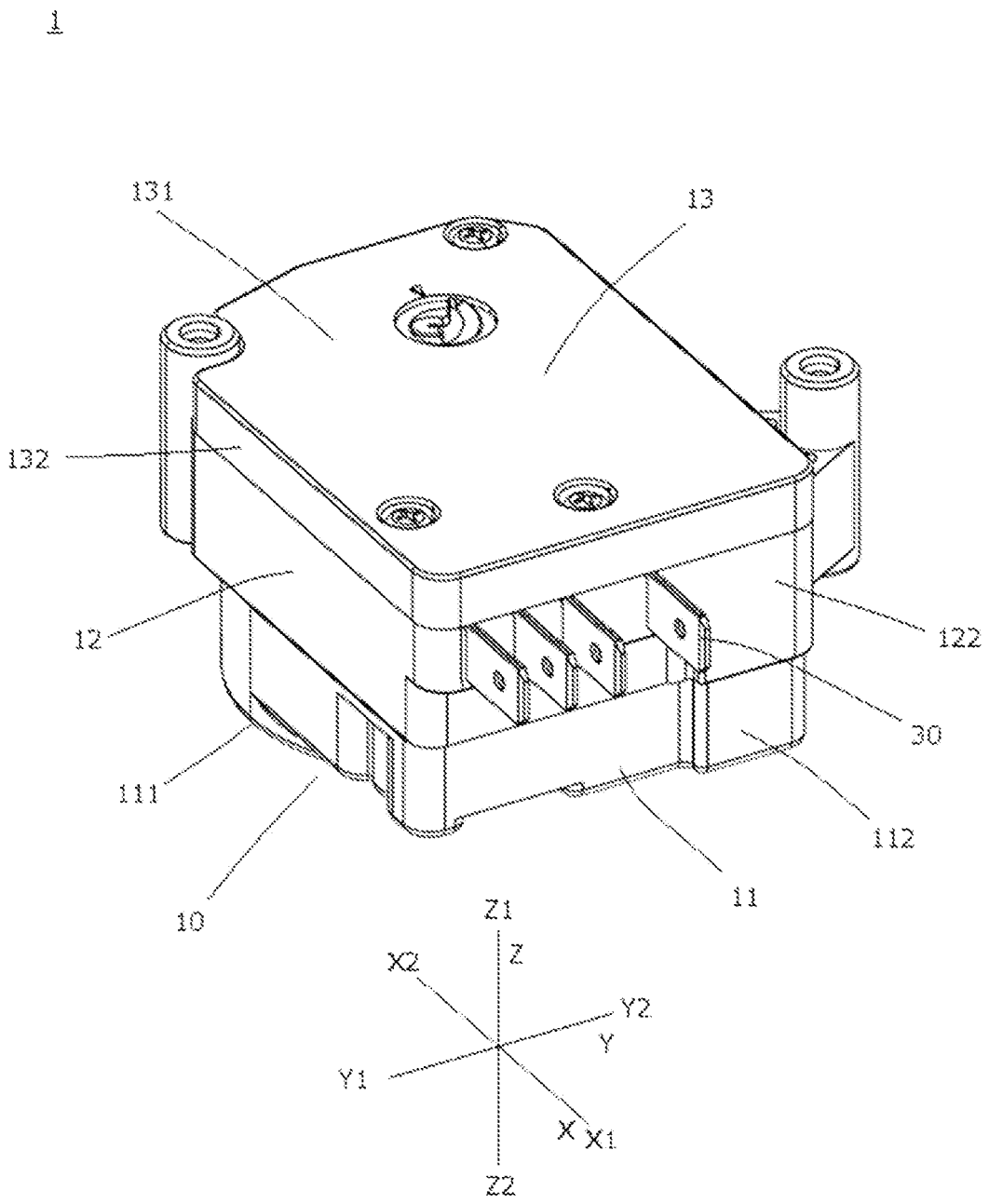
FIG. 1 is a perspective view illustrating a motor device according to an embodiment of the disclosure.

At least one embodiment of the disclosure provides a motor device, including a shell, a motor body and a connection terminal. The motor body is supported on the shell and includes a power supply terminal, a support, and a lead wire. The power supply terminal penetrates a through hole of the support in a first direction and is pressed into a pressing portion of the connection terminal. The lead wire extends from the power supply terminal in a direction perpendicular to the first direction, or extends in a direction inclined with respect to the first direction toward a side approaching the connection terminal. A first protrusion restricting movement of the power supply terminal in the first direction toward a side opposite to the connection terminal is provided at a position on the shell facing the power supply terminal in the first direction.

Here, the expression "restricting movement of the power supply terminal in the first direction toward a side opposite to the connection terminal" is not limited to the situation that an end of the power supply terminal opposite to the connection terminal abuts against the first protrusion, but also includes the situation that the end of the power supply terminal opposite to the connection terminal is appropriately spaced apart from the first protrusion.

According to the motor device of at least one embodiment of the disclosure, the first protrusion restricting the movement of the power supply terminal in the first direction toward the side opposite to the connection terminal is provided at the position on the shell facing the power supply terminal in the first direction. Thus, when the connection terminal is pressed into the power supply terminal in the first direction in the state in which the motor body is fixed to the shell, the lead wire is prevented from being tightened and broken due to excessive movement of the power supply terminal toward the side opposite to the connection terminal.

Further, in the motor device of at least one embodiment of the disclosure, preferably, a side of the first protrusion opposite to the power supply terminal is defined in a concave shape.

According to the motor device of at least one embodiment of the disclosure, the side of the first protrusion opposite to the power supply terminal is defined in the concave shape. Thus, a wall of the shell is easily uniformly defined, the material cost can be reduced, and the molding defects of the shell made of resin can be suppressed.

Further, in the motor device of at least one embodiment of the disclosure, preferably, a second protrusion restricting movement of the support in the first direction toward the side opposite to the connection terminal is provided at a position on the shell facing the support in the first direction.

According to the motor device of at least one embodiment of the disclosure, the second protrusion restricting the movement of the support in the first direction toward the side opposite to the connection terminal is provided at the position on the shell facing the support in the first direction. Thus, when the connection terminal is pressed into the power supply terminal in the first direction in the state in which the motor body is fixed to the shell, the situation that the connection terminal cannot be smoothly pressed into the power supply terminal due to deformation of the support is avoided, which improves the manufacturing efficiency.

Further, in the motor device of at least one embodiment of the disclosure, preferably, two power supply terminals are arranged at intervals in the direction perpendicular to the first direction and an extension direction of the lead wire. The second protrusion is located between the two power supply terminals.

According to the motor device of at least one embodiment of the disclosure, two power supply terminals are arranged at intervals in the direction perpendicular to the first direction and the extension direction of the lead wire, and the second protrusion is located between the two power supply terminals. Thus, when the connection terminal is pressed into the power supply terminal in the first direction in the state in which the motor body is fixed to the shell, the situation that the connection terminal cannot be smoothly pressed into the power supply terminal due to deformation of the support is further avoided, which improves the manufacturing efficiency.

Further, in the motor device of at least one embodiment of the disclosure, preferably, two power supply terminals are arranged at intervals in a second direction intersecting the first direction and an extension direction of the lead wire. Three or more connection terminals are arranged at intervals in the second direction. The support has three or more through holes corresponding to the pressing portions of the three or more connection terminals respectively in the first direction. The first protrusion is provided at a position corresponding to each of the three or more pressing portions in the first direction.

According to the motor device of at least one embodiment of the disclosure, two power supply terminals are arranged at intervals in the second direction intersecting the first direction and the extension direction of the lead wire, three or more connection terminals are arranged at intervals in the second direction, and the support has three or more through holes corresponding to the pressing portions of the three or more connection terminals respectively in the first direction. Thus, the position where the power supply terminal is provided on the support can be flexibly changed according to needs. In addition, the first protrusion is provided at the position corresponding to each of the three or more pressing portions in the first direction. Thus, even if the position of the power supply terminal on the support is changed, when the connection terminal is pressed into the power supply terminal in the first direction in the state in which the motor body is fixed to the shell, the lead wire is prevented from being tightened and broken due to excessive movement of the power supply terminal toward the side opposite to the connection terminal.

Further, in the motor device of at least one embodiment of the disclosure, preferably, the connection terminal has a guide portion closer to the support than the pressing portion. The guide portion is provided with a tapered hole that increases in diameter as it approaches the support. At least one end of the through hole is provided with a chamfered portion.

According to the motor device of at least one embodiment of the disclosure, the connection terminal has a guide portion closer to the support than the pressing portion, the guide portion is provided with a tapered hole that increases in diameter as it approaches the support, and at least one end of the through hole is provided with a chamfered portion. Thus, during manufacturing, the power supply terminal is easily pressed into the through hole of the support, which improves the manufacturing efficiency.

Further, in the motor device of at least one embodiment of the disclosure, preferably, an end of the power supply terminal opposite to the connection terminal abuts against the first protrusion.

According to the motor device of at least one embodiment of the disclosure, the end of the power supply terminal opposite to the connection terminal abuts against the first protrusion. Thus, when the connection terminal is pressed into the power supply terminal in the first direction in the state in which the motor body is fixed to the shell, the lead wire can be reliably prevented from being tightened and broken due to excessive movement of the power supply terminal toward the side opposite to the connection terminal.

Further, in the motor device of at least one embodiment of the disclosure, preferably, the power supply terminal is pressed into the through hole.

According to the motor device of at least one embodiment of the disclosure, the power supply terminal is pressed into the through hole, which reduces the manufacturing cost compared to the situation that the power supply terminal is held in the through hole by means of an adhesive or the like.

Further, in the motor device of at least one embodiment of the disclosure, preferably, the motor body includes a stator and a rotor. The stator has a coil wire constituting the lead wire. A front end of the coil wire is wound and fixed on a side of the power supply terminal opposite to the connection terminal relative to the support. The rotor is rotatable relative to the stator. A rotation center line of the rotor extends in the first direction. The support as a whole is in a plate shape extending from one side of the rotation center line toward an outer circumference and has a cylindrical portion extending in the first direction to define the through hole. The power supply terminal extends straight in the first direction and penetrates the outer circumference of the support.

Further, in the motor device of at least one embodiment of the disclosure, preferably, three or more connection terminals are arranged at intervals in the second direction intersecting the first direction and an extension direction of the lead wire. The three or more connection terminals each include a tab electrically connected to the outside and a conductive part connected to the tab. The conductive part has a contact. The motor device further includes a contact moving mechanism. The contact moving mechanism is supported on the shell and enables at least one of the contacts of the conductive parts to move to a position in contact with the other contacts to achieve electrical connection. The contact moving mechanism includes a cam and a gear transmission mechanism, the cam is rotatable about an axis extending in the first direction and has a cam surface on which the conductive parts slide, and the gear transmission mechanism transmits a driving force of the motor body to the cam.

According to at least one embodiment of the disclosure, the first protrusion restricting the movement of the power supply terminal in the first direction toward the side opposite to the connection terminal is provided at the position on the shell facing the power supply terminal in the first direction. Thus, when the connection terminal is pressed into the power supply terminal in the first direction in the state in which the motor body is fixed to the shell, the lead wire is prevented from being tightened and broken due to excessive movement of the power supply terminal toward the side opposite to the connection terminal.

Figure 2:
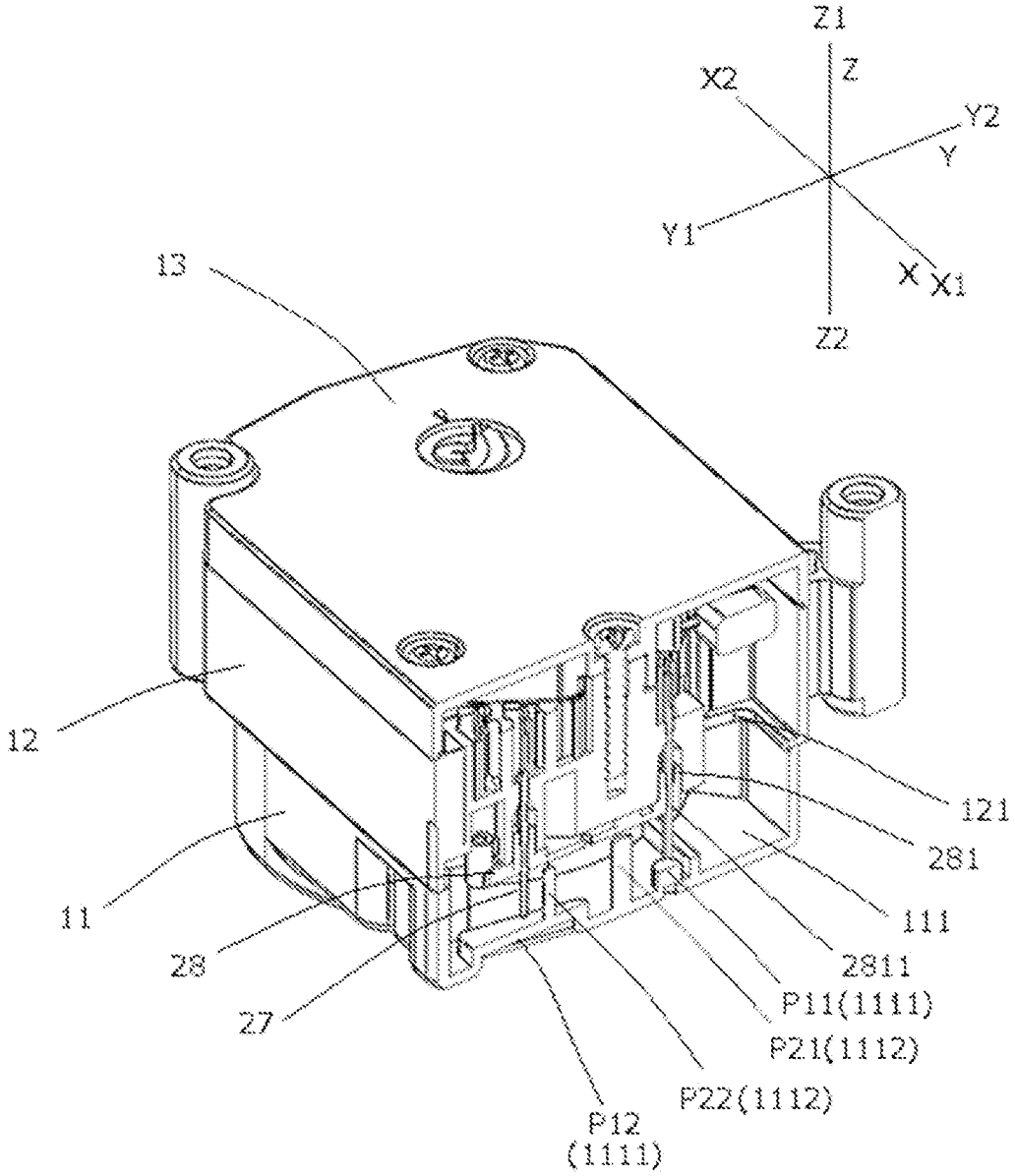
FIG. 2 is a cross-sectional perspective view illustrating the motor device according to the embodiment of the disclosure.
Figure 3:
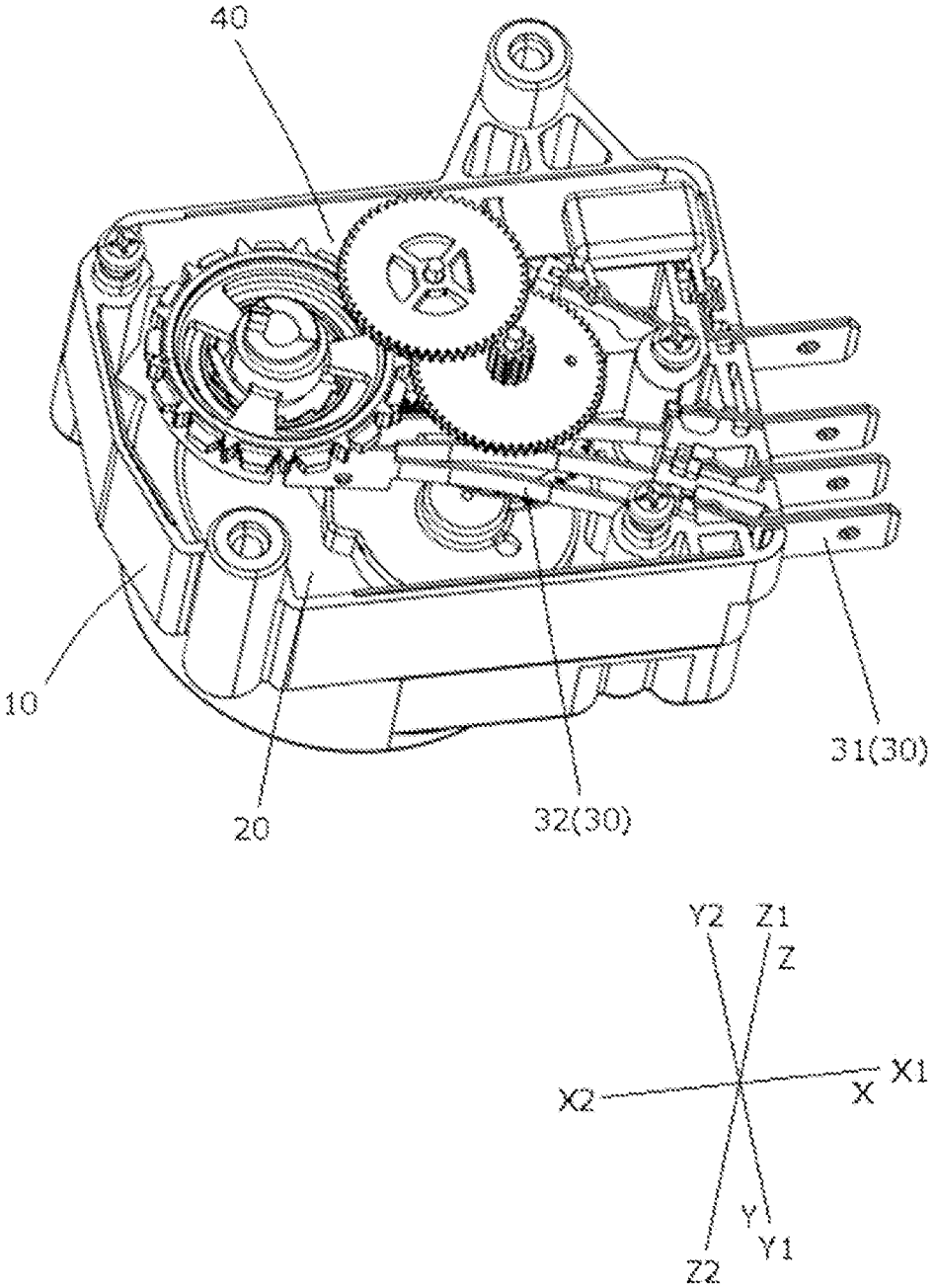
FIG. 3 is a perspective view illustrating the motor device according to the embodiment of the disclosure, where a part of a shell is omitted.
Figure 4:
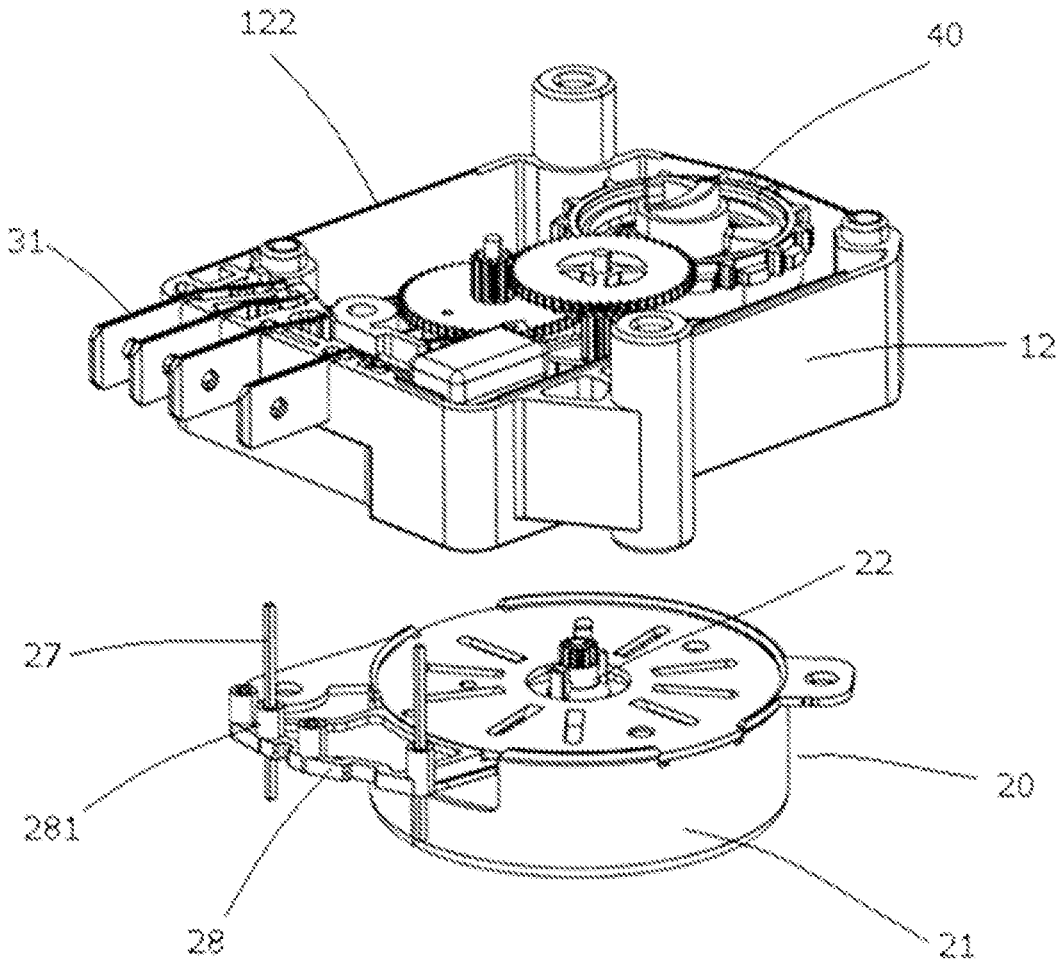
FIG. 4 is an exploded perspective view illustrating the motor device according to the embodiment of the disclosure, where a part of the shell and some components are omitted.
Figure 5:
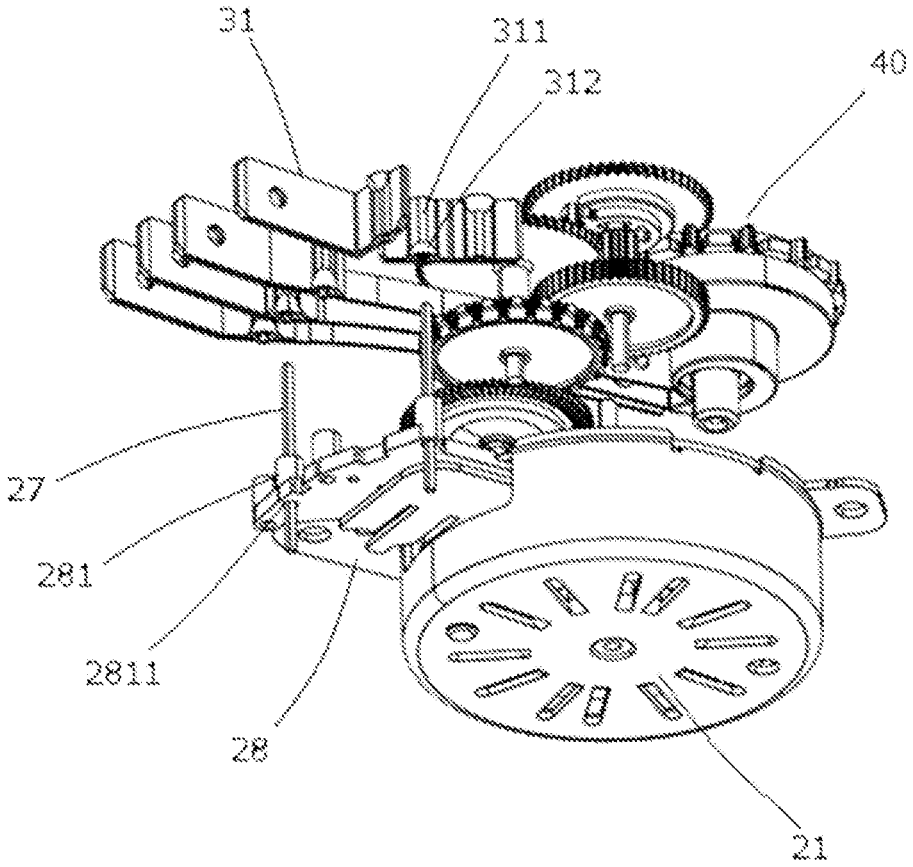
FIG. 5 is an exploded perspective view illustrating the motor device according to the embodiment of the disclosure, where a part of the shell and some components are omitted.
Figure 6:
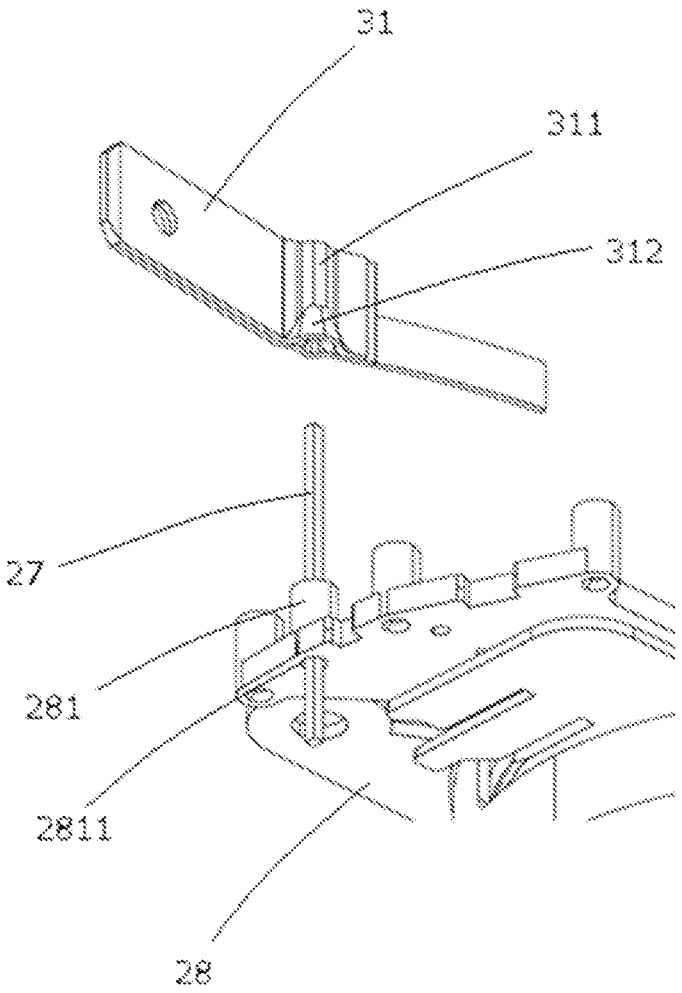
FIG. 6 is an exploded perspective view illustrating the motor device according to the embodiment of the disclosure, where the shell and some components are omitted.
Figure 7:
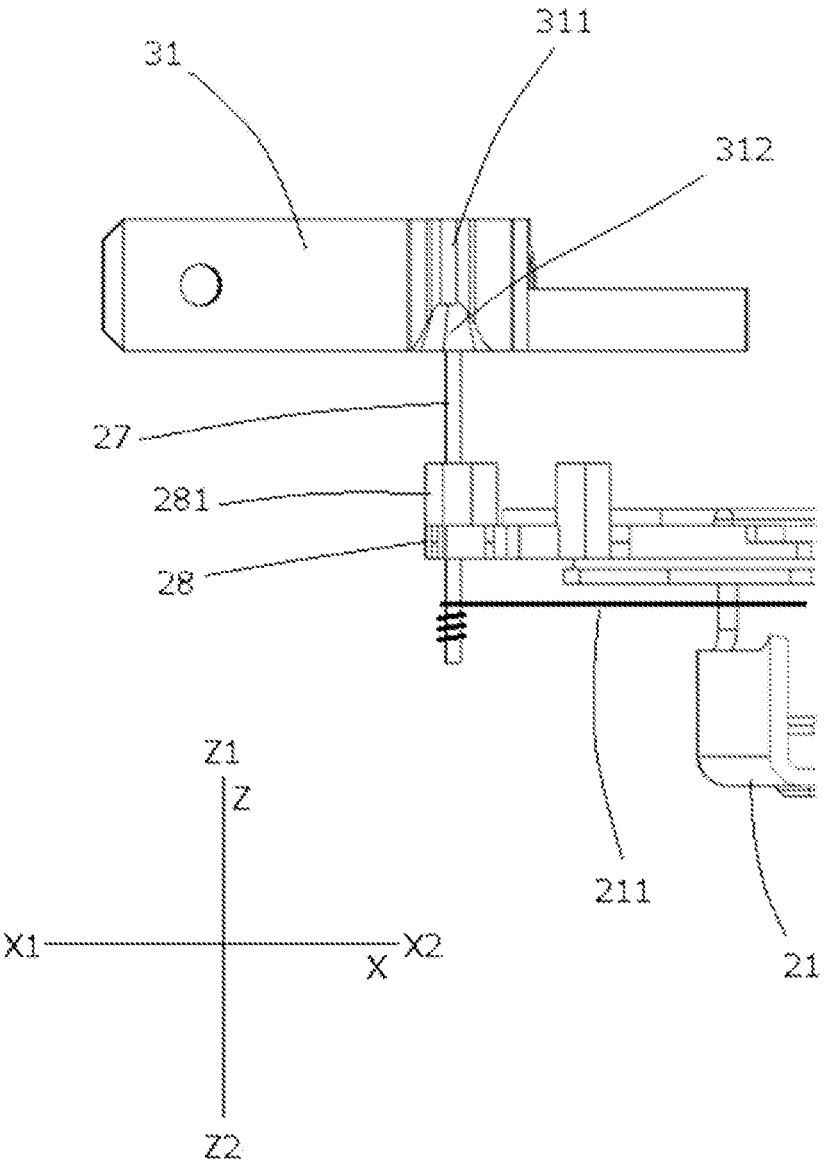
FIG. 7 is an exploded side view illustrating the motor device according to the embodiment of the disclosure, where the shell and some components are omitted.
Figure 8:
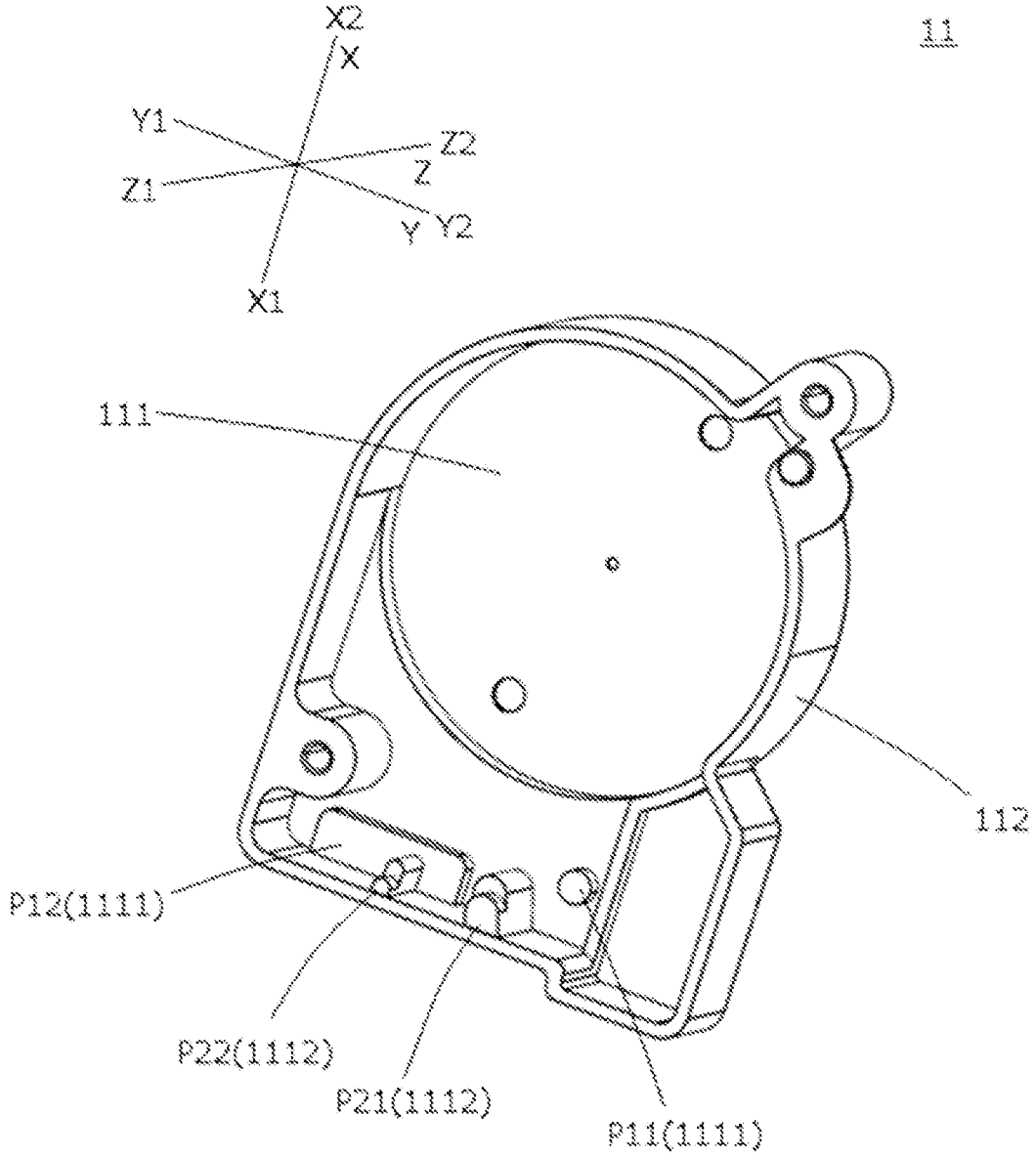
FIG. 8 is a perspective view illustrating a first shell included in the motor device according to the embodiment of the disclosure.

Hereinafter, a motor device according to an embodiment of the disclosure will be described with reference to FIGS. 1 to 8. FIG. 1 is a perspective view illustrating a motor device according to an embodiment of the disclosure; FIG. 2 is a cross-sectional perspective view illustrating the motor device according to the embodiment of the disclosure; FIG. 3 is a perspective view illustrating the motor device according to the embodiment of the disclosure, where a part of a shell is omitted; FIG. 4 is an exploded perspective view illustrating the motor device according to the embodiment of the disclosure, where a part of the shell and some components are omitted; FIG. 5 is an exploded perspective view illustrating the motor device according to the embodiment of the disclosure, where a part of the shell and some components are omitted; FIG. 6 is an exploded perspective view illustrating the motor device according to the embodiment of the disclosure, where the shell and some components are omitted; FIG. 7 is an exploded side view illustrating the motor device according to the embodiment of the disclosure, where the shell and some components are omitted; and FIG. 8 is a perspective view illustrating a first shell included in the motor device according to the embodiment of the disclosure.

Here, for convenience of description, three mutually orthogonal directions are set as an X direction, a Y direction, and a Z direction. One side of the X direction is set as X1, the other side of the X direction is set as X2, one side of the Y direction is set as Y1, the other side of the Y direction is set as Y2, one side of the Z direction is set as Z1, and the other side of the Z direction is set as Z2. In addition, the extension direction (i.e., the axial direction) of a rotation center line of a rotor of a motor body is the same as the Z direction.

As shown in FIGS. 1 to 4, the motor device 1 is a contact-type timing switch, including a shell 10, a motor body 20, a plurality of connection terminals 30 and a contact moving mechanism 40; the motor body 20, some of the connection terminals 30 and the contact moving mechanism 40 are received in the shell 10; some of the connection terminals 30 respectively include conductive parts 32 received in the shell 10, and each conductive part 32 has a contact; the contact moving mechanism 40 enables at least one of the contacts of the conductive parts 32 to move to a position in contact with other contacts to achieve electrical connection, and the contact moving mechanism 40 includes a cam and a gear transmission mechanism, wherein the cam has a cam surface on which the conductive parts 32 slide, and the gear transmission mechanism transmits the driving force of the motor body 20 to the cam.

Here, as shown in FIG. 3, the plurality of connection terminals 30 each have a tab 31, and some of the tabs 31 are used to electrically connect the conductive parts 32 with external parts.

As shown in FIGS. 1 and 2, the shell 10 includes a first shell 11, a second shell 12 and a third shell 13 sequentially stacked in the Z direction. The first shell 11, the second shell 12 and the third shell 13 enclose a receiving space for the motor body 20, the plurality of conductive parts 32 and the contact moving mechanism 40. The plurality of tabs 31 respectively penetrate through the shell 10.

Here, as shown in FIGS. 1 and 2, the first shell 11 has a bottom wall 111 and a surrounding wall 112 protruding from the circumferential edge of the bottom wall 111 toward the Z1 direction; the second shell 12 has a bottom wall 121 and a surrounding wall 122 protruding from the circumferential edge of the bottom wall 121 toward the Z1 direction; the third shell 13 has a top wall 131 and a surrounding wall 132 protruding from the circumferential edge of the top wall 131 toward the Z2 direction; the surrounding wall 112 of the first shell 11 and the surrounding wall 132 of the third shell 13 abut against the surrounding wall 122 of the second shell 12 from two sides in the Z direction; the motor body 20 is arranged in the space enclosed by the bottom wall 111 and surrounding wall 112 of the first shell 11 and the bottom wall 121 of the second shell 12; and the plurality of conductive parts 32 and the contact moving mechanism 40 are arranged in the space enclosed by the bottom wall 121 and surrounding wall 122 of the second shell 12 and the top wall 131 and surrounding wall 132 of the third shell 13. In addition, the first shell 11, the second shell 12 and the third shell 13 are fixed together by, for example, screws or the like.

As shown in FIGS. 1, 3, 4, 5 and 7, the motor body 20 is supported on the shell 10 and has power supply terminals 27, a support 28 and lead wires 211. The power supply terminals 27 penetrate through holes 2811 of the support 28 in the Z direction (equivalent to a first direction in at least one embodiment of the disclosure) and are pressed into pressing portions 311 of the connection terminals 30, and the lead wires 211 extend from the power supply terminals 27 in a direction perpendicular to the Z direction.

Here, as shown in FIGS. 1, 3, 4, 5 and 7, two power supply terminals 27 are arranged at intervals in the Y direction (equivalent to a second direction in at least one embodiment of the disclosure) intersecting the Z direction and the extension direction of the lead wires 211, each power supply terminal 27 is pressed into the through hole 2811 of the support 28, three or more (four in the illustrated example) connection terminals 30 are arranged at intervals in the Y direction, the three or more (four in the illustrated example) connection terminals 30 each have a pressing portion 311 (in the illustrated example, the pressing portion 311 is arranged on the tab 31), and the two power supply terminals 27 are pressed into two of the three or more pressing portions 311; the motor body 20 includes a stator 21 and a rotor 22, the stator 21 has coil wires constituting the lead wires 211 (the stator also has, for example, a stator core which is fixed to the shell 10 and on which the coil wires are wound), the front ends of the coil wires are wound and fixed on the Z2 direction sides of the power supply terminals 27 (that is, the sides opposite to the tabs 31 relative to the support 28), the rotor 22 rotates relative to the stator 21, and the rotation center line of the rotor 21 extends in the Z direction (the rotor has, for example, a rotor magnet); the whole support 28 is in the shape of a plate extending from one side of the rotation center line of the rotor 21 toward the outer circumference, and has three or more (four in the illustrated example) cylindrical portions 281 corresponding to the pressing portions 311 of the three or more connection terminals 30 respectively in the Z direction, and these cylindrical portions 281 are provided on the outer circumference of the support 28 and have through holes 2811 respectively.

As shown in FIG. 3, a plurality of connection terminals 30 are arranged in the Y direction.

Here, as shown in FIG. 3, four connection terminals 30 are arranged in the Y direction, each in the shape of a strip plate extending from the X2 direction toward the X1 direction, and each connection terminal 30 is elastically deformable in the length direction.

Further, as shown in FIG. 3, some (three connection terminals in the Y1 direction in the illustrated example) of the plurality of connection terminals 30 each include a conductive part 32 received in the shell 10. Further, each conductive part 32 is in the shape of a strip extending from the X2 direction to the X1 direction, and a contact is provided in the middle of each conductive part 32 in the length direction.

In addition, as shown in FIGS. 3 and 4, the connection terminals 30 each include a tab 31, the plurality of tabs 31 respectively protrude to the outside of the shell 10, some of the tabs 31 are respectively connected to the plurality of conductive parts 32, and the remaining tabs are connected (electrically connected) to the motor body 20. Specifically, one ends of some of the tabs 31 (three tabs in the Y1 direction in the illustrated example) are connected to the conductive parts 32, the remaining tabs (one tab closest to the Y2 direction in the illustrated example) are connected (electrically connected) to the motor body 20, the middle parts of the tabs 31 penetrate the surrounding wall 122 of the second shell 12 (the surrounding wall 122 in the X1 direction in the illustrated example), and the other ends of the tabs 31 protrude to the outside of the shell 10.

In addition, as shown in FIGS. 5 to 7, the connection terminal 30 has a pressing portion 311 and a guide portion 312 closer to the support 28 than the pressing portion 311; the pressing portion 311 is provided with a hole into which the power supply terminal 27 is pressed in the Z direction; and the guide portion 312 is provided with a tapered hole that increases in diameter as it approaches the support 28.

As described above, the contact moving mechanism 40 includes a cam and a gear transmission mechanism. The cam has a cam surface on which each conductive part 32 slides, and the cam rotates about an axis extending in the Z direction to move the contacts of the conductive parts 32. The gear transmission mechanism includes a plurality of gears, the gears are supported on the shell 10 by means of their shafts capable of rotating about the axis extending in the Z direction, and the gears transmit the driving force of the motor body 20 to the cam.

Here, because the contact moving mechanism 40 is not the focus of at least one embodiment of the disclosure, and may have the structure in the prior art mentioned in the background, details will not be repeated.

As shown in FIGS. 2 and 8, a first protrusion 1111 restricting the side movement of the power supply terminals 27 in the Z direction toward the side opposite to the connection terminals 30, that is, the Z2 direction side, is provided at the position of the shell 10 facing the power supply terminals 27 in the Z direction. In addition, a second protrusion 1112 restricting the side movement of the support 28 in the Z direction toward the side opposite to the connection terminals 30 that is, the Z2 direction side, is provided at the position of the shell 10 facing the support 28 in the Z direction. In addition, the side of the first protrusion 1111 opposite to the power supply terminal 27, that is, the Z2 direction side is defined in a concave shape.

Here, as shown in FIGS. 2, 5 and 8, the first protrusion 1111 is provided at the position of the bottom wall 111 of the first shell 11 corresponding to the pressing portions 311 of the three or more (four in the illustrated example) tabs 31 in the Z direction, the first protrusion 1111 is separated (for example, separated by small gaps) from the ends of the power supply terminals 27 in the Z2 direction, the first portion 1111 includes a first protrusion first portion P11 and a first protrusion second portion P12 separated in the Y direction, the first protrusion first portion P11 is opposite to one of the three or more (four in the illustrated example) pressing portions 311 in the Z direction (defined in the shape of a column extending from the bottom wall 111 toward the Z1 direction in the illustrated example), the first protrusion second portion P12 is opposite to the rest of the three or more pressing portions 311 in the Z direction (defined in the shape of a rectangular platform protruding from the bottom wall 111 toward the Z1 direction), and the Z2 direction side of the first protrusion first portion P11 and the Z2 direction side of the first protrusion second portion P12 are defined in a concave shape; and the second protrusion 1112 is located between the two power supply terminals 27 (between the two power supply terminals 27 in the Y direction in the illustrated example), the second protrusion 1112 includes a second protrusion first portion P21 and a second protrusion second portion P22 separated in the Y direction, and the second protrusion second portion P22 is located on the side opposite to the first protrusion first portion P11 relative to the second protrusion first portion P21 (in the illustrated example, the second protrusion first portion P21 protrudes from the bottom wall 111 toward the Z1 direction, the second protrusion first portion P21 is located between the first protrusion first portion P11 and the first protrusion second portion P12, the second protrusion second portion P22 protrudes from the first protrusion second portion P12 toward the Z1 direction, and the second protrusion first portion P21 and the second protrusion second portion P22 are respectively in the shape of a slender column.

According to the motor device 1 of this embodiment, the first protrusion 1111 restricting the movement of the power supply terminals 27 in the Z direction toward the side opposite to the connection terminals 30 is provided at the position of the shell 10 facing the power supply terminals 27 in the Z direction, so when the connection terminals 30 are pressed into the power supply terminals 27 in the Z direction in the state in which the motor body 20 is fixed to the shell 10, the lead wires 211 are prevented from being tightened and broken due to excessive movement of the power supply terminals 27 toward the side opposite to the connection terminals 30, that is, the Z2 direction side.

At least one embodiment of the disclosure is exemplarily described above with reference to the accompanying drawings. Apparently, the specific implementation of at least one embodiment of the disclosure is not limited by the above embodiment.

For example, in the above embodiment, the motor device 1 is a contact-type timing switch, but is not limited thereto, and may be a device for other purposes.

Further, in the above embodiment, the lead wires 211 extend from the power supply terminals 27 in the direction perpendicular to the Z direction, but at least one embodiment of the disclosure is not limited thereto, and the lead wires 211 may extend from the power supply terminals 27 in a direction inclined with respect to the Z direction toward the side approaching the connection terminals 30.

Further, in the above embodiment, the first protrusion 1111 is separated from the ends of the power supply terminals 27 in the Z2 direction, but at least one embodiment of the disclosure is not limited thereto, and the first protrusion 1111 may abut against the ends of the power supply terminals 27 in the Z2 direction.

Further, in the above embodiment, the power supply terminals 27 extend straight in the Z direction, but at least one embodiment of the disclosure is not limited thereto, and the power supply terminals 27 may be defined in a zigzag shape or the like.

Further, in the above embodiment, the side of the first protrusion 1111 opposite to the power supply terminals 27 may not be defined in the concave shape.

Further, in the above embodiment, the whole support 28 is in the shape of a plate and has cylindrical portions 281, but at least one embodiment of the disclosure is not limited thereto, and the support 28 may be defined in other shape or not have the cylindrical portions 281.

Further, in the above embodiment, chamfered portions may be defined at the ends of the through holes 2811 of the support 28 in the Z1 direction and/or the Z2 direction.

Further, in the above embodiment, the power supply terminals 27 penetrate through the outer circumference of the support 28 in the Z direction, but at least one embodiment of the disclosure is not limited thereto, and the part of the support 28 through which the power supply terminals 27 penetrate may be other part.

Further, in the above embodiment, the power supply terminals 27 are respectively pressed into the through holes 2811 of the support 28, but at least one embodiment of the disclosure is not limited thereto, and the power supply terminals 27 may be inserted and bonded to the through holes 2811 of the support 28.

Further, in the above embodiment, the second protrusion 1112 may be omitted.

Features of the above-described preferred embodiments and the modifications thereof may be combined appropriately as long as no conflict arises.

While preferred embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A motor device, comprising a shell;

a motor body, supported on the shell and comprising at least one power supply terminal, a support, and a lead wire; and at least one connection terminal, wherein the at least one power supply terminal penetrates a through hole of the support in a first direction and is pressed into a pressing portion of the at least one connection terminal, the lead wire extends from the at least one power supply terminal in a direction perpendicular to the first direction, or extends in a direction inclined with respect to the first direction toward a side approaching the at least one connection terminal, and a first protrusion restricting movement of the at least one power supply terminal in the first direction toward a side opposite to the at least one connection terminal is provided at a position on the shell facing the at least one power supply terminal in the first direction.

2. The motor device according to claim 1, wherein a side of the first protrusion opposite to the at least one power supply terminal is defined in a concave shape.

3. The motor device according to claim 1, wherein the at least one power supply terminal comprises two power supply terminals arranged at intervals in a second direction intersecting the first direction and an extension direction of the lead wire, the at least one connection terminal comprises three or more connection terminals arranged at intervals in the second direction, the support has three or more through holes corresponding to the pressing portions of the three or more connection terminals respectively in the first direction, and the first protrusion is provided at a position corresponding to each of the three or more pressing portions in the first direction.

4. The motor device according to claim 1, wherein the at least one connection terminal has a guide portion closer to the support than the pressing portion, the guide portion is provided with a tapered hole that increases in diameter as it approaches the support, and at least one end of the through hole is provided with a chamfered portion.

5. The motor device according to claim 1, wherein an end of the at least one power supply terminal opposite to the at least one connection terminal abuts against the first protrusion.

6. The motor device according to claim 1, wherein the at least one power supply terminal is pressed into the through hole.

7. The motor device according to claim 1, wherein the motor body comprises a stator and a rotor, the stator has a coil wire constituting the lead wire, a front end of the coil wire is wound and fixed on a side of the at least one power supply terminal opposite to the at least one connection terminal relative to the support, the rotor is rotatable relative to the stator, a rotation center line of the rotor extends in the first direction, the support as a whole is in a shape of a plate which extends from one side of the rotation center line toward an outer circumference, and the support has a cylindrical portion extending in the first direction to define the through hole, and the at least one power supply terminal extends straight in the first direction and penetrates the outer circumference of the support.

8. The motor device according to claim 1, wherein the at least one connection terminal comprises three or more connection terminals arranged at intervals in a second direction intersecting the first direction and an extension direction of the lead wire, the three or more connection terminals each comprise a tab electrically connected to the outside and a conductive part connected to the tab, the conductive part has a contact, the motor device further comprises a contact moving mechanism, the contact moving mechanism is supported on the shell and enables at least one of the contacts of the conductive parts to move to a position in contact with the other contacts to achieve electrical connection, the contact moving mechanism comprises a cam and a gear transmission mechanism, the cam is rotatable about an axis extending in the first direction and has a cam surface on which the conductive parts slide, and the gear transmission mechanism transmits a driving force of the motor body to the cam.

9. The motor device according to claim 1, wherein a second protrusion restricting movement of the support in the first direction toward the side opposite to the at least one connection terminal is provided at a position on the shell facing the support in the first direction.

10. The motor device according to claim 9, wherein the at least one power supply terminal comprises two power supply terminals arranged at intervals in the direction perpendicular to the first direction and an extension direction of the lead wire, and the second protrusion is located between the two power supply terminals.

* * * * *